US007072609B2

(12) United States Patent
Karasawa

(10) Patent No.: US 7,072,609 B2
(45) Date of Patent: Jul. 4, 2006

(54) APPARATUS AND METHOD FOR IMAGE FORMING CAPABLE OF PERFORMING AN IMPROVED IMAGE FIXING USING A COOLER

(75) Inventor: Kazunori Karasawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 100 days.

(21) Appl. No.: 10/843,556

(22) Filed: May 12, 2004

(65) Prior Publication Data

US 2005/0008388 A1 Jan. 13, 2005

(30) Foreign Application Priority Data

May 12, 2003 (JP) ..... 2003-133329

(51) Int. Cl.
*G03G 15/20* (2006.01)
*G03G 21/20* (2006.01)

(52) U.S. Cl. ..... 399/327; 399/92; 399/94

(58) Field of Classification Search ..... 399/92, 399/94, 327

See application file for complete search history.

(56) References Cited

U.S. PATENT DOCUMENTS 3,929,095 A * 12/1975 Thettu ..... 399/327 X
4,772,918 A 9/1988 Karasawa et al.
4,962,394 A 10/1990 Sohmiya et al.
5,006,896 A 4/1991 Koichi et al.
5,038,175 A 8/1991 Sohmiya et al.
5,500,720 A 3/1996 Karasawa
5,594,539 A 1/1997 Murano et al.
5,678,134 A * 10/1997 Miki et al. ..... 399/327 X
6,141,509 A 10/2000 Karasawa
6,339,690 B1 1/2002 Karasawa
6,456,814 B1 9/2002 Karasawa
6,487,389 B1 * 11/2002 Jia et al. ..... 399/327
6,501,917 B1 12/2002 Karasawa
2002/0028401 A1 * 3/2002 Macholdt et al. ..... 430/108.23

FOREIGN PATENT DOCUMENTS

JP 2001-83831 3/2001
JP 2001-350360 12/2001

* cited by examiner

*Primary Examiner*—Sandra L. Brase
(74) *Attorney, Agent, or Firm*—Oblon, Spivak, McClelland, Maier & Neustadt, P.C.

(57) ABSTRACT

An image forming apparatus capable of preventing toner offset is disclosed that includes an image forming mechanism and a fixing device. The fixing device includes a fixing rotator, a pressure rotator, a cleaning roller, a temperature detector, and a cooler. The temperature detector detects a surface temperature of at least one of the fixing rotator, the pressure rotator, and the cleaning roller. The cooler operates based on the temperature detected by the temperature detector. An image forming method and an image fixing method are also described.

22 Claims, 5 Drawing Sheets

APPARATUS AND METHOD FOR IMAGE FORMING CAPABLE OF PERFORMING AN IMPROVED IMAGE FIXING USING A COOLER

CROSS-REFERENCE TO RELATED APPLICATIONS

This patent specification is based on Japanese patent application No. JPAP2003-133329, filed on May 12, 2003 in the Japanese Patent Office, the entire contents of which are incorporated by reference herein.

BACKGROUND OF THE INVENTION

1. Field of the Invention

The present invention relates to an apparatus and method for image forming, and more particularly to an apparatus and method for image forming capable of preventing toner offset in an image fixing by using a cooler.

2. Discussion of the Background

In a background image forming apparatus using Electrophotography such as a copier, a printer, and a facsimile, an image is formed through various steps including charging, exposing, developing, transferring, fixing, cleaning, and discharging.

In the fixing step, a toner image is generally fixed to a transfer sheet by heating and pressing the toner image using a fixing roller and a pressure roller. However, the heated toner may be melted and adhered to the surface of the fixing roller, which comes into direct contact with the toner. The toner adhered to the surface of the fixing roller may be then transferred back to the transfer sheet (the so-called "toner offset"), thereby deteriorating the image quality.

One approach for preventing toner offset is to use toner containing a polymer having a high molecular weight. However, the toner has such a high glass transition temperature that an image needs to be fixed at a high temperature. Thus, high-speed image forming or energy saving may not be easily attained.

To meet the demand for high-speed image forming or energy saving, toner containing a polyester resin having a low fixing temperature is preferably used. In practice, however, the toner containing a polyester resin tends to melt at a lower temperature, thereby causing the toner offset problem more easily. Therefore, there is a need for preventing toner offset, particularly when a toner containing a polyester resin is used.

In order to prevent toner offset, the temperature of the background image forming apparatus is controlled by stopping or slowing down its operation. Such a background image forming apparatus successfully prevents toner offset, however, it suffers from a lower productivity. In addition, the background image forming apparatus fails to completely eliminate the toner offset when a toner containing a polyester resin is used.

SUMMARY OF THE INVENTION

In view of the foregoing, it is an object of the present invention to provide a novel image forming apparatus capable of preventing toner offset.

Another object of the present invention is to provide a novel fixing device capable of preventing toner offset.

Another object of the present invention is to provide a novel image forming method for preventing toner offset.

Another object of the present invention is to provide a novel image fixing method for preventing toner offset.

To achieve the above and other objects, in one example, an image forming apparatus includes an image forming mechanism and a fixing device. The fixing device includes a fixing rotator, a pressure rotator, at least one cleaning roller, at least one detector, and a cooler. The fixing rotator and the pressure rotator closely contact with each other. The at least one cleaning roller closely contacts with at least one of the fixing rotator and the pressure rotator. The at least one detector detects a surface temperature of at least one of the fixing rotator, the pressure rotator, and the cleaning rotator. The cooler lowers the surface temperature of the at least one cleaning roller based on the detected surface temperature.

The above cooler may operate when the detected surface temperature is substantially equal to or above a predetermined value.

The above toner may contain at least a polyester resin.

Further, the above toner may be prepared by dispersing a toner composition containing at least a polyester resin, a colorant, a releasing agent in an aqueous medium in the presence of resin fine particles, and applying a polymerization addition reaction to a resultant toner composition.

To achieve the above and other objects, in one example, a novel image forming method includes the steps of forming, fixing, cleaning, detecting, and lowering. The forming step forms a toner image on a transfer sheet using toner. The fixing step fixes the toner image by using a fixing rotator and a pressure rotator. The cleaning step cleans toner adhering to at least one of the fixing rotator and the pressure rotator by using a cleaning rotator. The detecting step detects a temperature of at least one of the fixing rotator, the pressure rotator and the cleaning rotator. The lowering step lowers the temperature of the cleaning rotator based on the temperature detected by the detecting step.

The above lowering step may start operation when the temperature detected by the detecting step is substantially equal to or above a predetermined value.

The above toner may contain at least a polyester resin.

The above toner may be prepared by dispersing a toner composition containing at least a polyester resin, a colorant, a releasing agent in an aqueous medium in the presence of resin fine particles, and applying a polymerization addition reaction to a resultant toner composition.

In addition to the novel image forming apparatus and method as described above, the present invention may be implemented in other ways, including as an image fixing device and an image fixing method, within the scope of this disclosure and appended claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
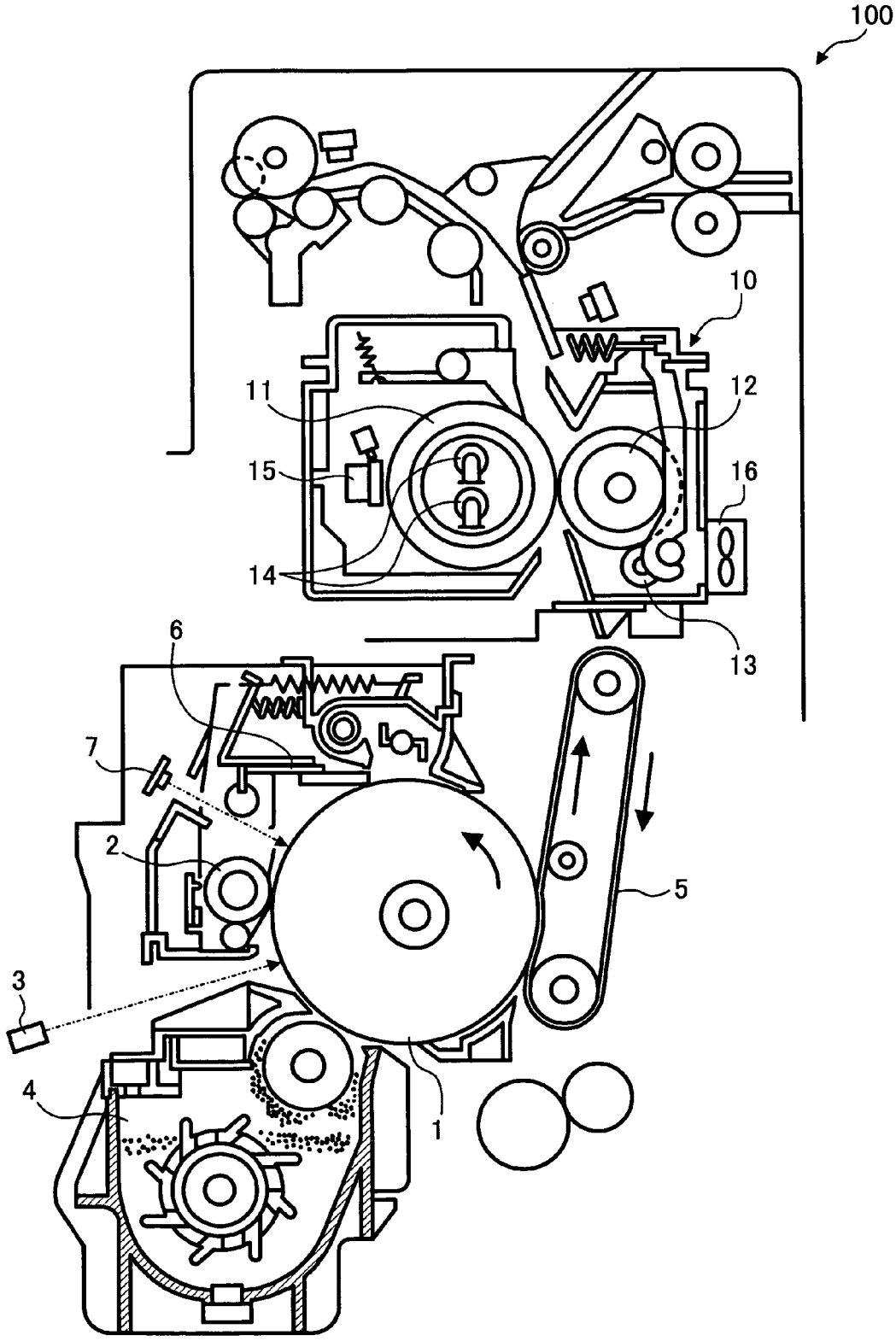
FIG. 1 is a schematic diagram illustrating an image forming apparatus including a fixing device according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus 100 according to an exemplary embodiment of the present invention is explained.

In FIG. 1, a photoconductor 1 rotates in a counterclockwise direction as indicated by an arrow. Around the photoconductor 1 are arranged a charging device 2, an exposure device 3, a developing device 4, a transfer device 5, a cleaning device 6, a discharging device 7, and the fixing device 10.

The charging device 2 uniformly charges the surface of the photoconductor 1. The exposure device 3 irradiates a laser light on the surface of the photoconductor 1 to form an electrostatic latent image thereon. The developing device 4 applies toner to the electrostatic latent image to form a toner image. The transfer device 5 transfers the toner image to a transfer sheet. The fixing device 10 fixes the toner image to the transfer sheet. The transfer sheet is then output from the image forming apparatus 100 to complete an image forming process.

After the transfer of the toner image to the transfer sheet, a small amount of toner remains on the surface of the photoconductor 1. The cleaning device 6 removes this remaining toner. The discharging device 7 discharges the surface of the photoconductor 1 for a next image forming process.

The fixing device 10 includes a fixing roller 11, a pressure roller 12, a cleaning roller 13, a plurality of heaters 14, a plurality of fixing roller temperature detectors 15, and a cooler 16.

The fixing roller 11 and the pressure roller 12 closely contact each other while forming a nip therebetween. In this example, the fixing roller 11 and the pressure roller 12 are made of rollers, however, they may be formed of belts or plates.

The fixing roller 11 includes a core made of aluminum coated with a fluorocarbon resin. The pressure roller 12 includes a core made of aluminum, an elastic layer made of foamed silicon rubber, and a heat-resistant releasing layer containing a fluorocarbon resin. However, the fixing roller 11 and the pressure roller 12 are not limited to the mentioned examples.

As shown in FIG. 1, the cleaning roller 13 closely contacts the pressure roller 12. However, the cleaning roller 13 may contact the fixing roller 11. Alternatively, another cleaning roller may be provided to the fixing roller 11 in addition to the one provided to the pressure roller 12. The cleaning roller 13 may be made of an aluminum heat pipe, however, the cleaning roller 13 is not limited to this example.

In this example, the pressure roller 12 and the cleaning roller 13 are rotatably driven by the rotation of the fixing roller 11. However, the pressure roller 12 may be implemented as a main drive driving the fixing roller 11 and the cleaning roller 13.

Figure 5:
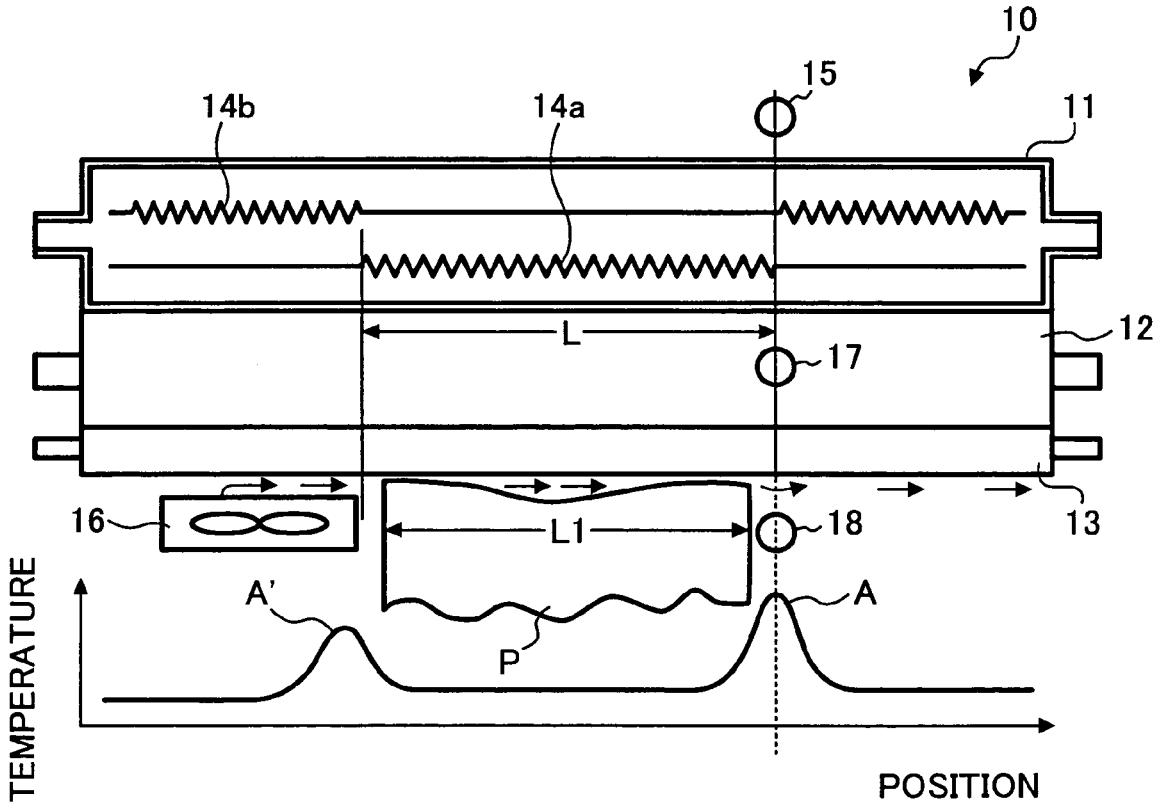
FIG. 5 is a graph illustrating the variation of temperature as a function of position in a fixing device.

The plurality of heaters 14 include a central heater 14*a* and a side heater 14*b* (FIG. 5). The central heater 14*a* applies heat via the fixing roller 11 to the central portion of the transfer sheet passing through the nip. The side heater 14*b* applies heat via the fixing roller 11 to the side portions of the transfer sheet passing through the nip. In operation, at least one of the plurality of heaters 14 (14*a* and 14*b*) is turned on according to the size of the transfer sheet. In the present example, two heaters are incorporated, however, one or more than two heaters may be implemented.

The plurality of fixing roller temperature detectors 15 is provided in the vicinity of the fixing roller 11 to measure the surface temperature of the fixing roller 11. In FIG. 1, one fixing roller temperature detector 15 is arranged on the surface of the fixing roller 11, and another fixing roller temperature detector 15 (not shown) is arranged in the axial direction of the fixing roller 11. However, one or more than two fixing roller temperature detectors may be arranged in the vicinity of the fixing roller 11.

Based on the temperature of the fixing roller 11 detected by at least one of the plurality of fixing roller temperature detectors 15, at least one of the plurality of heaters 14 can be automatically or manually turned on or off so as to keep the surface temperature of the fixing roller 11 below a predetermined value.

The cooler 16 reduces the surface temperature of the cleaning roller 13 if it exceeds a predetermined value. In this example, a fan is particularly used as the cooler 16, however, any type of cooler having a similar cooling function may be used including a water cooling mechanism or a duct transporting cooling air from another fan.

In the fixing process, the transfer sheet is conveyed from the transfer device 5 through the nip formed between the fixing roller 11 and the pressure roller 12. At least one of the plurality of heaters 14 applies heat via the fixing roller 11 to the toner image carried by the transfer sheet. At the same time, the pressure roller 12 applies pressure to the transfer sheet to fix the toner image thereon. The transfer sheet is then conveyed from the nip to be discharged onto a tray (not shown).

Although the fixing roller 11 has a surface made of a material having a high releasing property to prevent toner from adhering thereto, a small amount of toner may remain on the fixing roller 11 after the fixing process. The toner remained on the fixing roller 11 is transferred to the pressure roller 12 having a releasing property lower than that of the fixing roller 11. The cleaning roller 13 removes the toner adhering to the surface of the pressure roller 12. As a result, the toner is prevented from transferring back to the sheet.

The toner used in the present example is known as a polyester polymerization toner, which contains at least a polyester resin, a coloring agent, and a releasing agent to ensure a high image quality. An exemplary method for preparing the polyester polymerization toner is summarized below.

In an organic solvent such as ethyl acetate, toner ingredients containing at least a resin, a colorant, wax as a releasing agent, a charge controlling agent, and an isocyanate group-containing polyester resin (i.e., prepolymer) are dissolved to form a toner composition. The toner composition and amines are dispersed by shear forces in an aqueous medium in the presence of a surface active agent, a viscosity adjusting agent, and resin fine particles to form an emulsified dispersion liquid. The liquid is heated so as to enhance an extension or cross-linking reaction of the isocyanate group and the amines. An organic solvent is removed from the liquid, for example, by gradually increasing the temperature of the liquid to obtain toner particles. Foreign substances (the surface active agent or the viscosity adjusting agent) remaining on the surface of the toner particles are also removed. The toner particles thus obtained are collected by filtration and dried. If desired, external additive fine particles (silica, titanium, alumina, etc.) may be added to the outer surfaces of the toner particles by a mixer.

When toner having a higher molecular weight is used, the toner adhering to the cleaning roller 13 hardly melts unless the temperature of the fixing device 10 becomes excessively high. On the contrary, when a polyester polymerization toner is used, the toner tends to easily melt even at a low temperature, separates from the cleaning roller 13, and adheres to the fixing roller 11 or the pressure roller 12.

In order to prevent the toner, particularly a polyester polymerization toner, from melting, the image forming apparatus 100 further includes the cooler 16. The cooler 16 reduces the temperature of the cleaning roller 13 so as to prevent toner on its surface from melting.

The cooler 16 may continuously operate, however, may preferably operate only when necessary for the following reasons. If the cooler 16 continuously operates, it takes more time to raise the temperature of the fixing device 10 to a value required for image fixing, particularly when the image forming apparatus 100 is turned on after a long period of non-use. Further, the continuous operation of the cooler 16 may generate noise or consume more energy.

Figure 2:
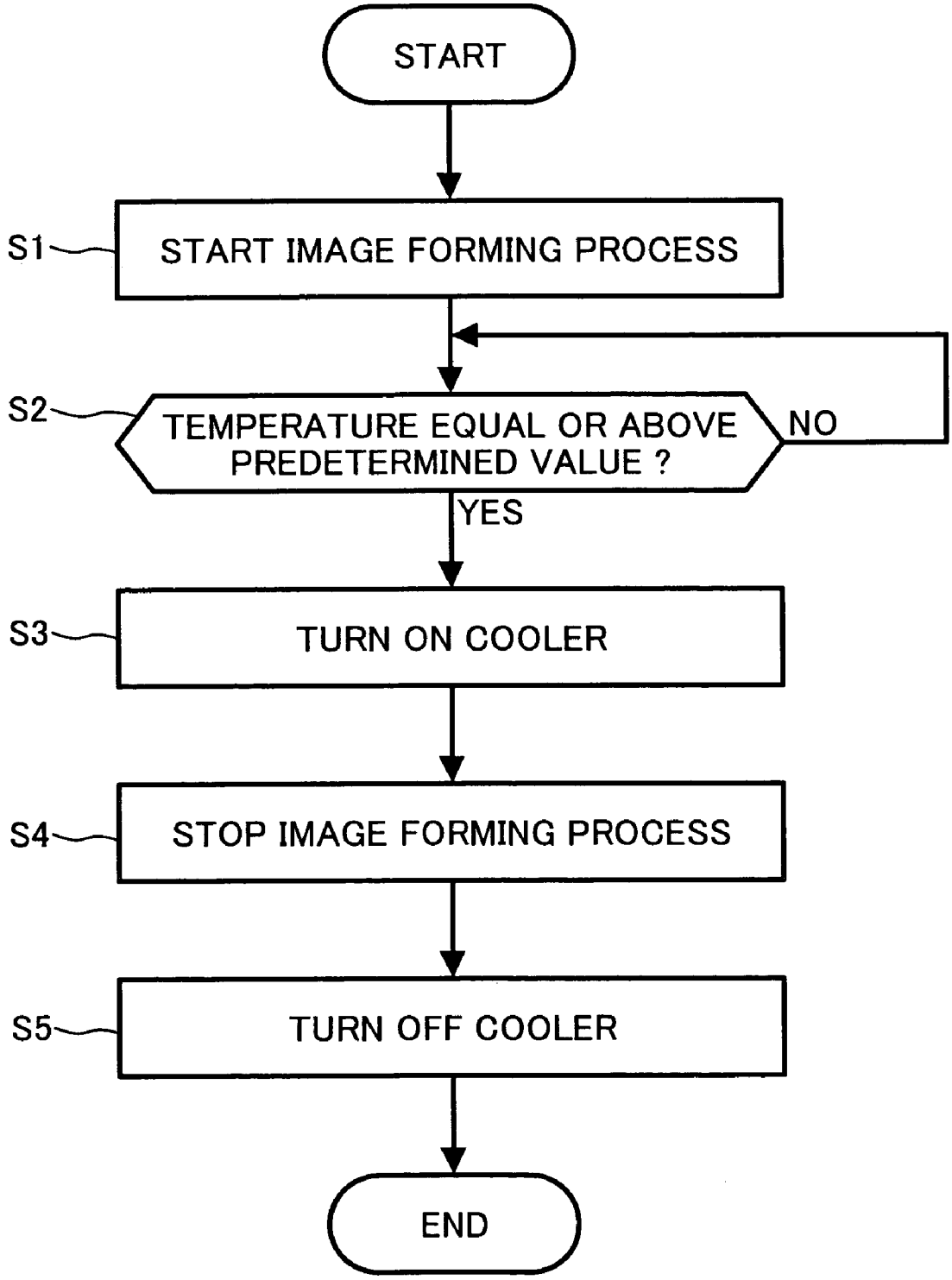
FIG. 2 is a flowchart illustrating an operation of controlling a cooler in an image forming apparatus.

In light of the above, the image forming apparatus 100 may control the operation of the cooler 16 by turning it on or off. FIG. 2 is a flowchart illustrating an exemplary control operation of the cooler 16 performed by the image forming apparatus 100.

In Step S1, an image forming process is started. In Step S2, the fixing roller temperature detector 15 determines whether the surface temperature of the fixing roller 11 has reached a predetermined value. The predetermined surface temperature value has been previously set corresponding to a surface temperature of the cleaning roller 13 above which toner on the cleaning roller 13 melts. Once this predetermined surface temperature is reached in Step 2, the process moves to Step S3, otherwise, the operation in Step 2 is repeated. In Step S3, the cooler 16 is turned on to reduce the surface temperature of the cleaning roller 13. In Step S4, the image forming process is stopped either due to completion of the image forming job or interruption by a user. In Step S5, the cooler 16 is turned off.

As described above, the predetermined temperature corresponds to a surface temperature of the cleaning roller 13 above which toner adhering to the cleaning roller 13 melts. The process of selecting this predetermined temperature value may take into consideration a relationship between the surface temperature of the fixing roller 11 and the surface temperature of the cleaning roller 13. Particularly, in this example, the predetermined value is set to 150° C. However, the predetermined value differs depending on various conditions including the size, the image forming speed, and the structure of the image forming apparatus in use, the softening point of toner, and the size of a transfer sheet. In one example, an image forming apparatus having a low image forming speed can sufficiently prevent toner offset with a lower predetermined value.

Further, the predetermined value may be set manually through a control panel, etc., by a user according to the various conditions as described above. Furthermore, the predetermined value may be set through an external device, such as a personal computer, connected to the image forming apparatus 100 through a communication line, etc.

Figure 3:
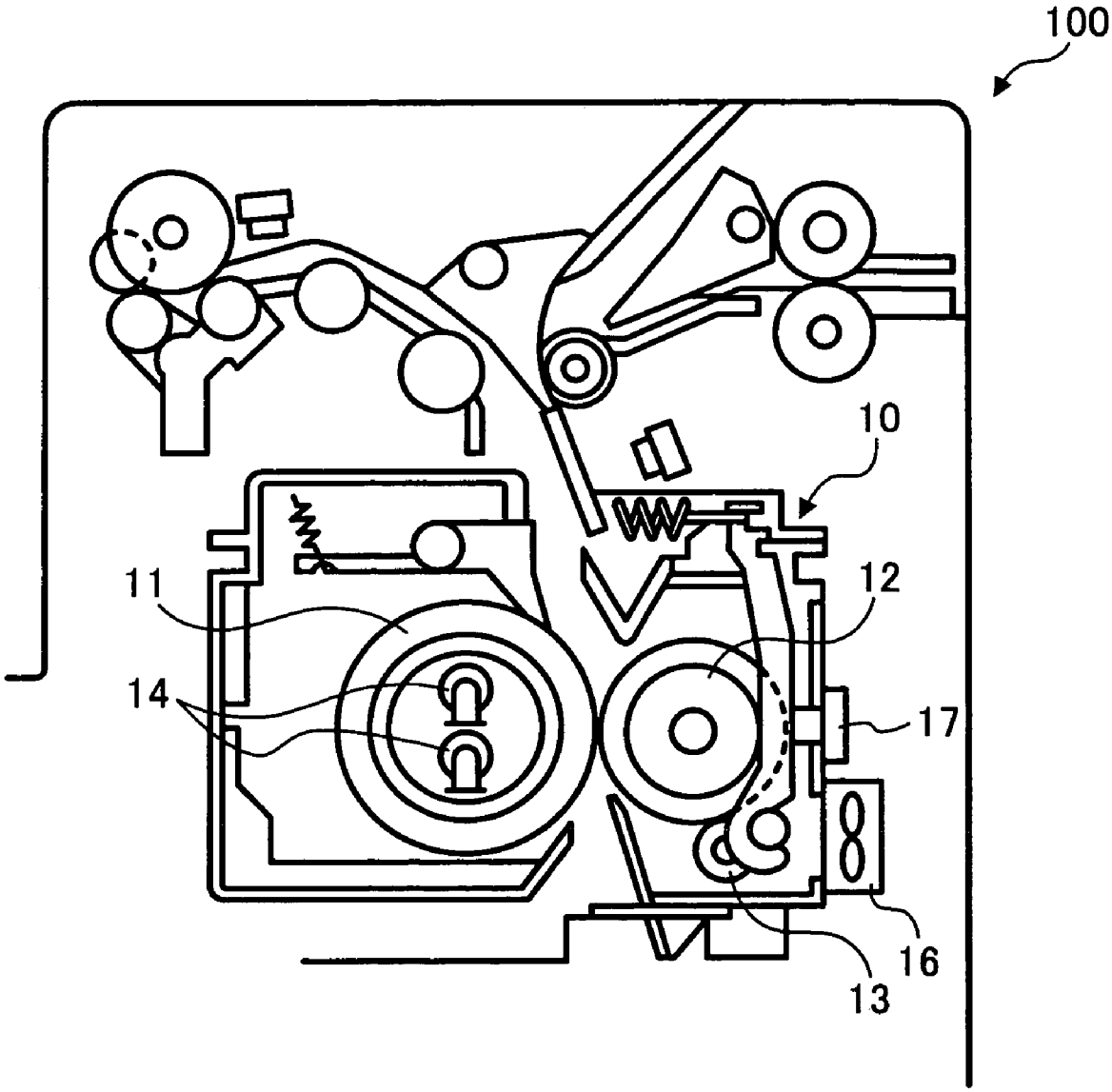
FIG. 3 is a schematic diagram illustrating an image forming apparatus including a fixing device according to another embodiment of the present invention.

Next, an image forming apparatus 100 including a fixing device 10 according to another exemplary embodiment of the present invention is explained with reference to FIG. 3. The fixing device 10 of FIG. 3 is similar to the one illustrated in FIG. 1, except that the plurality of fixing roller temperature detectors 15 of FIG. 1 is replaced with a pressure roller temperature detector 17 arranged in the vicinity of the pressure roller 12 to measure its surface temperature. In FIG. 3, only one pressure roller temperature detector 12 is provided, however, one or more than two detectors may be provided.

In a similar manner as described with reference to FIG. 1, the cooler 16 may be turned on or off based on the surface temperature of the pressure roller 12. In this case, Step S2 in FIG. 2 determines whether or not the surface temperature of the pressure roller 12 detected by the pressure roller temperature detector 17 has reached a predetermined value.

Figure 4:
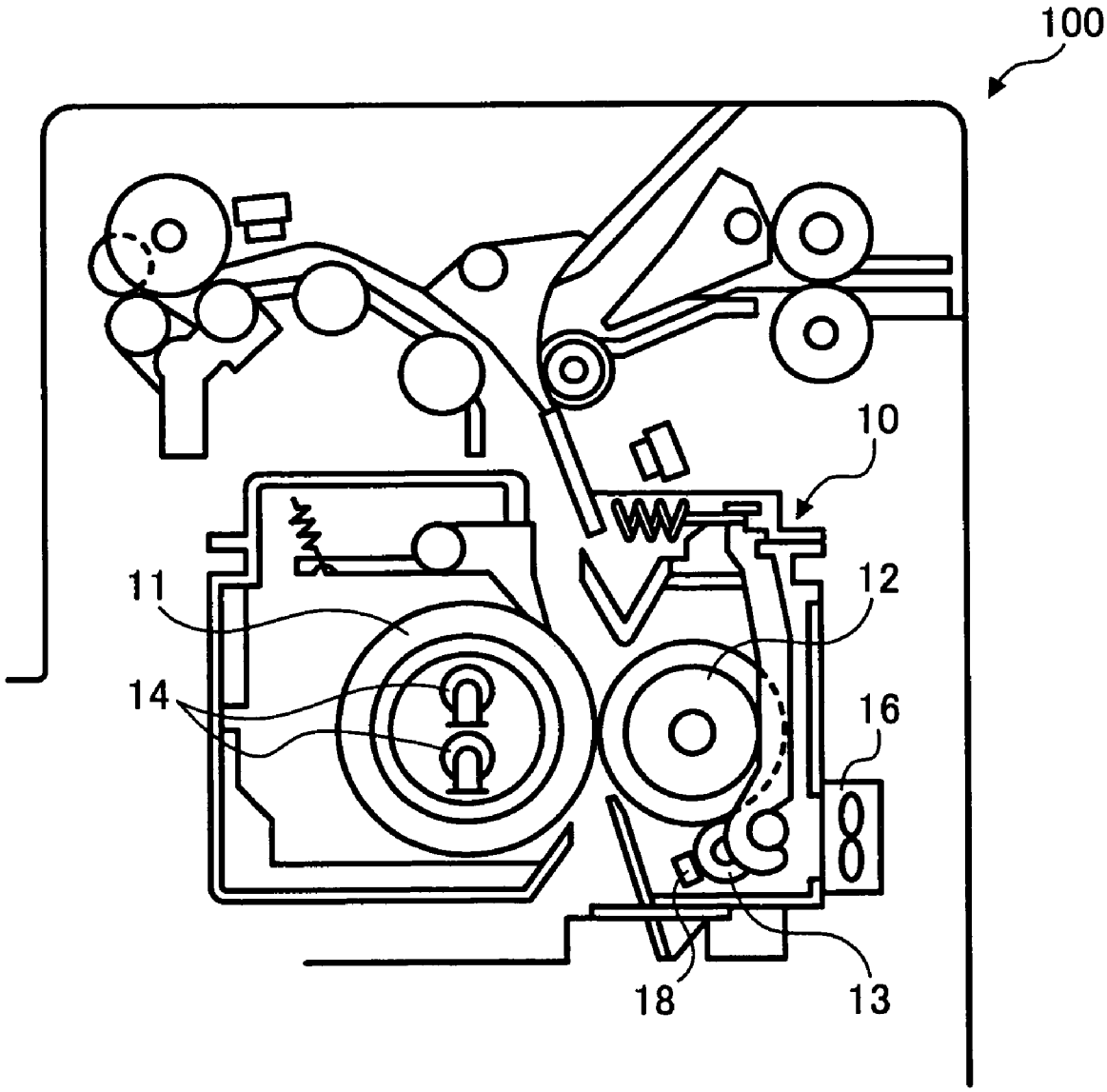
FIG. 4 is a schematic diagram illustrating an image forming apparatus including a fixing device according to another embodiment of the present invention.

Next, an image forming apparatus 100 including a fixing device 10 according to another exemplary embodiment of the present invention will be explained with reference to FIG. 4. The fixing device 10 of FIG. 4 is similar to the one shown in FIG. 1, except that the plurality of fixing roller temperature detectors 15 of FIG. 1 is replaced with a cleaning roller temperature detector 18. The cleaning roller temperature detector 18 is arranged in the vicinity of the cleaning roller 13 to measure its surface temperature. In FIG. 4, only one cleaning roller temperature detector 18 is provided, however, one or more than two detectors may be provided.

In a similar manner as described with reference to FIG. 1, the cooler 16 may be turned on or off based on the surface temperature of the cleaning roller 13. In this case, Step S2 in FIG. 2 determines whether or not the surface temperature of the cleaning roller 13 detected by the cleaning roller temperature detector 18 has reached a predetermined value.

As described earlier, in one example, one fixing roller temperature detector 15 may be provided to the fixing roller 11. In another example, one pressure roller temperature detector 17 may be provided to the pressure roller 12. In another example, one cleaning roller temperature detector 18 may be provided to the cleaning roller 13. In either of the cases, it is preferable to arrange any of the fixing roller temperature detector 15, the pressure roller temperature detector 17, and the cleaning roller temperature detector 18 (hereinafter, collectively referred to as a temperature detector) at a location having the highest temperature.

Referring to FIG. 5, a preferable location to install the temperature detector will be explained. In FIG. 5, the fixing roller 11 incorporates a plurality of heaters 14, including the central heater 14*a* and the side heater 14*b*. A transfer sheet P passes through the nip between the fixing roller 11 and the pressure roller 12. Air circulated from the cooler 16 passes along the cleaning roller 13 from the left to the right, as indicated by arrows, to cool down the surface of the cleaning roller 13.

In one example, the transfer sheet P has a length L1 smaller than a length L of the central heater 14*a*. In this case, the side heater 14*b* is turned off. When the central heater 14*a* is turned on to generate heat, the transfer sheet P passing through the nip absorbs a fraction of the heat corresponding to the length L1. The remaining heat not absorbed by the transfer sheet P raises the surrounding temperatures, particularly at points A and A' as indicated in FIG. 5. When the cooler 16 is turned on, the air, flowing from the left to the right, lowers the temperature of point A' at a higher rate than that at point A. Therefore, for this particular embodiment, the temperature detector is preferably installed at point A, the point of highest temperature, to effectively prevent the toner from melting.

However, in the case of the cleaning roller temperature detector, if the cleaning roller is made of a highly conductive material such as a heat pipe, the surface temperature of the cleaning roller becomes uniform such that the cleaning roller temperature detector may be installed in any arbitrary location.

Further, when installing the fixing roller temperature detector, sufficient space is required between the fixing roller temperature detector and the fixing roller in order to avoid damage to the fixing roller. Thus, a printed surface of the transfer sheet, which directly contacts the fixing roller, can be protected. Such a consideration does not apply to the installation of pressure roller or cleaning roller temperature detectors.

Numerous additional modifications and variations are possible in light of the above teachings. It is therefore to be understood that within the scope of the appended claims, the disclosure of this patent specification may be practiced otherwise than as specifically described herein.

For example, elements and/or features of different illustrative embodiments may be combined with each other and/or substituted for each other within the scope of this disclosure and appended claims.

The invention claimed is:

1. An image forming apparatus, comprising:

an image forming mechanism configured to form a toner image on a transfer sheet; and a fixing device configured to fix the toner image to the transfer sheet, the fixing device comprising:

a fixing rotator;

a pressure rotator closely contacting the fixing rotator;

at least one cleaning roller closely contacting at least one of the fixing rotator and the pressure rotator;

at least one detector configured to detect a surface temperature of the pressure rotator; and a cooler configured to lower the surface temperature of the cleaning roller based on the temperature detected by the at least one detector.

2. The image forming apparatus of claim 1, wherein operation of the at least one cooler starts when the temperature detected by the at least one detector is substantially equal to or above a predetermined value.

3. The image forming apparatus of claim 1, further comprising a toner comprising at least a polyester resin.

4. The image forming apparatus of claim 1, further comprising a toner prepared by dispersing a toner composition containing at least a polyester resin, a colorant, a releasing agent in an aqueous medium in the presence of resin fine particles, and applying a polymerization addition reaction to a resultant toner composition.

5. An image forming apparatus, the apparatus comprising:

means for forming a toner image on a transfer sheet;

heating means for heating the toner image;

pressing means for pressing the toner image;

cleaning means for cleaning a toner adhering to at least one of the heating means and the pressing means;

detecting means for detecting a temperature of the pressing means; and cooling means for lowering the temperature of the cleaning means based on the temperature detected by the detecting means.

6. The image forming apparatus of claim 5, wherein operation of the cooling means starts when the temperature detected by the detecting means is substantially equal to or above a predetermined value.

7. An image forming method, comprising the steps of:

forming a toner image on a transfer sheet;

fixing the toner image by using a fixing rotator and a pressure rotator;

cleaning toner adhering to at least one of the fixing rotator and the pressure rotator by using a cleaning rotator;

detecting a temperature of the pressure rotator; and lowering the temperature of the cleaning rotator based on the temperature detected by the detecting step.

8. The image forming method as defined in claim 7, wherein the lowering step starts when the temperature detected by the detecting step is substantially equal to or above a predetermined value.

9. The image forming method of claim 7, wherein a toner of the toner image comprises at least a polyester resin.

10. The image forming method of claim 7, wherein a toner of the toner image is prepared by dispersing a toner composition containing at least a polyester resin, a colorant, a releasing agent in an aqueous medium in the presence of resin fine particles, and applying a polymerization addition reaction to a resultant toner composition.

11. A fixing device for fixing a toner image, the device comprising:

a fixing rotator;

a pressure rotator closely contacting the fixing rotator;

at least one cleaning roller closely contacting at least one of the fixing rotator and the pressure rotator;

at least one detector configured to detect a surface temperature of the pressure rotator; and a cooler configured to lower the surface temperature of the cleaning roller based on the temperature detected by the at least one detector.

12. The fixing device of claim 11, wherein operation of the cooler starts when the temperature detected by the at least one detector is substantially equal to or above a predetermined value.

13. The fixing device of claim 11, wherein a toner of the toner image contains at least a polyester resin.

14. The fixing device of claim 11, wherein a toner of the toner image is prepared by dispersing a toner composition containing at least a polyester resin, a colorant, a releasing agent in an aqueous medium in the presence of resin fine particles, and applying a polymerization addition reaction to a resultant toner composition.

15. A fixing device for fixing a toner image, the device comprising:

heating means for heating the toner image;

pressing means for pressing the toner image;

cleaning means for cleaning a toner adhering to at least one of the heating means and the pressing means;

detecting means for detecting a temperature of the pressing means; and cooling means for lowering the temperature of the cleaning means based on the temperature detected by the detecting means.

16. The fixing device of claim 15, wherein operation of the cooling means starts when the temperature detected by the detecting means is substantially equal to or above a predetermined value.

17. An image fixing method for fixing a toner image formed with toner, the method comprising the steps of:

fixing the toner image by using a fixing rotator and a pressure rotator;

cleaning toner adhering to at least one of the fixing rotator and the pressure rotator by using a cleaning roller;

detecting a temperature of the pressure rotator; and lowering the temperature of the cleaning roller based on the temperature detected by the detecting step.

18. The image fixing method of claim 17, wherein the lowering step starts when the temperature detected by the detecting step is substantially equal to or above a predetermined value.

19. The image fixing method of claim 17, wherein the toner contains at least a polyester resin.

20. The image fixing method of claim 17, wherein the toner is prepared by dispersing a toner composition containing at least a polyester resin, a colorant, a releasing agent in an aqueous medium in the presence of resin fine particles, and applying a polymerization addition reaction to a resultant toner composition.

21. An image forming apparatus, comprising:

an image forming mechanism configured to form a toner image on a transfer sheet; and a fixing device configured to fix the toner image to the transfer sheet, the fixing device comprising:

a fixing rotator;

a pressure rotator closely contacting the fixing rotator;

a cleaning roller closely contacting at least one of the fixing rotator and the pressure rotator;

first, second, and third detectors configured to detect corresponding surface temperatures of the fixing rotator, the pressure rotator, and the cleaning roller; and a cooler configured to lower the surface temperature of the cleaning roller based at least on one of the temperatures detected by the first, second, and third one detector.

22. An image forming method, comprising:

forming a toner image on a transfer sheet;

fixing the toner image by using a fixing rotator and a pressure rotator;

cleaning toner adhering to at least one of the fixing rotator and the pressure rotator by using a cleaning rotator;

detecting surface temperatures of the fixing rotator, the pressure rotator and the cleaning rotator; and lowering the temperature of the cleaning rotator based at least on one of the detected surface temperatures.

* * * * *